US005885108A

United States Patent [19]

Gerrans, Jr.

[11] Patent Number: 5,885,108

[45] Date of Patent: Mar. 23, 1999

[54] ELECTRICAL CONNECTOR

[75] Inventor: Albert H. Gerrans, Jr., Hempstead, Tex.

[73] Assignee: A-G. Geophysical Products, Inc., Cypress, Tex.

[21] Appl. No.: 813,879

[22] Filed: Mar. 7, 1997

Related U.S. Application Data

[62] Division of Ser. No. 347,797, Dec. 1, 1994, Pat. No. 5,641,307.

[51] Int. Cl.[6] ..... H01R 13/58

[52] U.S. Cl. ..... 439/606; 439/693

[58] Field of Search ..... 439/606, 736, 439/445, 447, 686, 695, 693

[56] References Cited

U.S. PATENT DOCUMENTS

| | | | |
|---|---|---|---|
| 2,843,153 | 7/1958 | Young | 138/55 |
| 2,866,957 | 12/1958 | Raypholtz | 339/60 |
| 3,449,182 | 6/1969 | Wiltshire | 156/69 |
| 3,497,864 | 2/1970 | Barnet | 339/60 |
| 3,643,208 | 2/1972 | Massa, Jr. | 339/102 R |
| 3,693,133 | 9/1972 | Harbonn et al. | 439/278 |
| 4,461,529 | 7/1984 | Farrss | 339/102 R |
| 4,589,939 | 5/1986 | Mohebban et al. | 156/49 |
| 4,820,170 | 4/1989 | Redmond et al. | 439/66 |
| 4,861,288 | 8/1989 | Friedman | 439/736 |
| 5,100,341 | 3/1992 | Czyz et al. | 439/447 |
| 5,120,268 | 6/1992 | Gerrans | 439/736 |
| 5,387,119 | 2/1995 | Wood | 439/281 |
| 5,470,248 | 11/1995 | Wood | 439/281 |
| 5,542,856 | 8/1996 | Wood | 439/281 |

*Primary Examiner*—Gary F. Paumen
*Attorney, Agent, or Firm*—Matthews & Associates, L.L.P.

[57] ABSTRACT

An electrical connector and method of construction of an electrical connector of the type for use in seismic operations in corrosive environments is provided. The electrical connector assembly includes: a substantially hard plastic housing having a first end and a second end having an annular lip defining a chamber, the housing encapsulating at least one electrical connector therein, a section of the electrical connector extending into the chamber; an open ended shell connected to the annular lip; an insulated, electrical conductor connected to the electrical connector and extending outwardly therefrom; a potting material disposed within the chamber and about the connection between the electrical connector and the electrical conduit; and a tail member extending from the annular lip over the shell and a section of the insulated electrical conductor and bonded thereto. Wherein the plastic tail being made of a material substantially the same as the housing and irrevocably fused to the housing, but which is softer than the housing.

20 Claims, 2 Drawing Sheets

ELECTRICAL CONNECTOR

This application is a division, of application Ser. No. 08/347,797 filed Dec. 1, 1994, now U.S. Pat. No. 5,641,307.

BACKGROUND OF THE INVENTION

Underwater electrical cables and marine conductors in general cause major problems when they begin to leak. Leakage of course is common due to the fact that such cables, and their connectors, commonly operate in subsurface environments or in near surface atmospheric environments characterized by extreme salt and humidity. The primary water and humidity sealing means in underwater connectors is generally the insulation encapsulating the strands of individual conductors, or it is an encapsulating plastic around the machined stainless steel connector. Frequently, these connectors are made of corrosion resistant metals, such as stainless, or the like, and are coated with a plastic coating for the purpose of precluding entry of moisture.

Further, in marine seismic operations, underwater electrical plugs or connectors are needed to connect power and instrumentation conductors to other equipment, such as seismic sound generators, i.e., air guns. These "guns" are used as a sound source to obtain acoustic reflections from the sea-floor. Typically, they are fired every ten to fifteen seconds producing extremely strong pressure waves. As a result, the electrical cables, conductors and connectors are subjected to a great deal of structural abuse, and normally they may not last for extended periods of time before developing leaks or other operational defects. Therefore, all of the electrical connectors and other components used in these harshest of environments must necessarily withstand repeated explosive forces on their exteriors while allowing for a degree of flexibility there within lest the internal conductor be jolted loose from its external housing. In addition, these electrical connectors must be able to withstand corrosive environments such as in sub-sea, swamp and marsh operations.

The inventor originally believed that the best way to obtain a marine electrical connector which would satisfactorily handle the type of punishment which would be incurred, based upon the foregoing conditions, was by having a rigid or very strong external housing material which would not fracture while simultaneously precluding leakage from the environment and mounting the electrical conductor inside the housing within a flexible shock absorbent material. The shock absorbent material was to allow for the repeated percussive forces, which would be incurred without producing a short in the circuit. This previous invention is described and claimed in U.S. Pat. No. 5,120,268, which was issued on Jun. 9, 1992. In that application, the Applicant pointed out that he was unaware of electrical conductors which utilized flexible shock absorbent interiors, and that it was common for the exterior and interior of electrical connectors to be comprised of different materials, such as, for example, metal and rubber, thus requiring difficult and expensive bonding techniques which frequently result in unreliable adhesion. Applicant further notes, that this is believed to be true whenever different materials of substantially different hardness and/or density are bonded together. Applicant's concepts remain true to date and the present invention expands upon those principals in light of the development of a new and improved marine electrical connector.

Applicant's main advantage with respect to the previous invention was that two types of plastic were utilized to comprise the electrical connector and the connectors were not made of stainless steel or any other metal alloy normally resistant to corrosion and other abusive environmental conditions, thereby greatly decreasing the cost of the connector. Instead, Applicant utilized a method for making reliable, multi-component, electrical connectors which, theretofore, were not capable of a reliable, permanent fusion to one another. The dual material electrical connector of the invention was characterized by a flexible shock absorbent internal core and relatively hard external housing each fusionly connected to one another in an irrevocable bond. Applicant discovered the use of the glass impregnated external housing consisting of a hard plastic material and an interior shock absorbent material of substantially the same plastic which obviated the short comings of the prior art. This combination not only enabled the production of electrical connectors having operational advantages over that which had been known theretofore, but it also markedly simplified the manufacturing of connectors and reduced the expense thereof.

In the present invention, Applicant has designed away from the hard external housing and instead now utilizes a soft plastic external housing which is fused to a connector element and which is still more than sufficiently capable of withstanding the shocks and abuses incurred by marine electrical connectors and is even less susceptible to leakage than the prior art. Further, the present invention greatly reduces the steps required to manufacture the connector, thereby, once again, reducing cost and time in the manufacturing process, while yielding an even more desirable end product. The present invention is also even more capable of providing leakage protection and withstanding harsh and corrosive environmental elements and operational conditions than the prior art connectors.

SUMMARY OF INVENTION

It is thus an object of the invention to provide a marine electrical connector that solves the problems described above, and which can be utilized in corrosive environments.

It is a further object of the present invention to provide an electrical connector having improved shock absorbing capabilities utilizing a flexible external covering that minimizes electrical circuit disturbance.

It is a still further object of the present invention to provide a marine connector which not only has greater shock absorbing capabilities, but also has greater leakage prevention characteristics for use in sub-sea conditions and other corrosive environments.

It is a still further object of the present invention to provide a marine connector which remarkably reduces the substantial cost associated with prior art connectors characterized by a plurality of component parts and manufacturing steps, thereby providing for a more cost effective and time saving manufacturing process.

Accordingly, an electrical connector of the type for use in seismic operations in corrosive environments is provided. The electrical connector assembly includes: a substantially hard plastic housing having a first end and a second end having an annular lip defining a chamber, the housing encapsulating at least one electrical connector therein, a section of the electrical connector extending into the chamber; an open ended shell connected to the annular lip; an insulated, electrical conductor connected to the electrical connector and extending outwardly therefrom; a potting material disposed within the chamber and about the connection between the electrical connector and the electrical conduit; and a tail member extending from the annular lip over the shell and a section of the insulated electrical conductor and bonded thereto.

In a preferred embodiment, the tail member is made of a material substantially the same as the housing and irrevocably fused at the annular lip but which is softer than the housing. More preferably the tail member is constructed of polyurethane and the housing is a fiberglass impregnated polyurethane. The fiberglass impregnated in the housing constitutes between 15 and 65 percent of the weight thereof.

The electrical connector of the present invention may also include a pressure nut connected to the shell opposite the connection to the annular lip, thereby, enclosing the connection of the conductor and the connector with in the shell. The electrical connector assembly may further include, a connector piece or clamping mandrel. The connector piece connected about a longitudinal section of the housing.

DESCRIPTION OF THE PREFERRED EMBODIMENT

Figure 1:
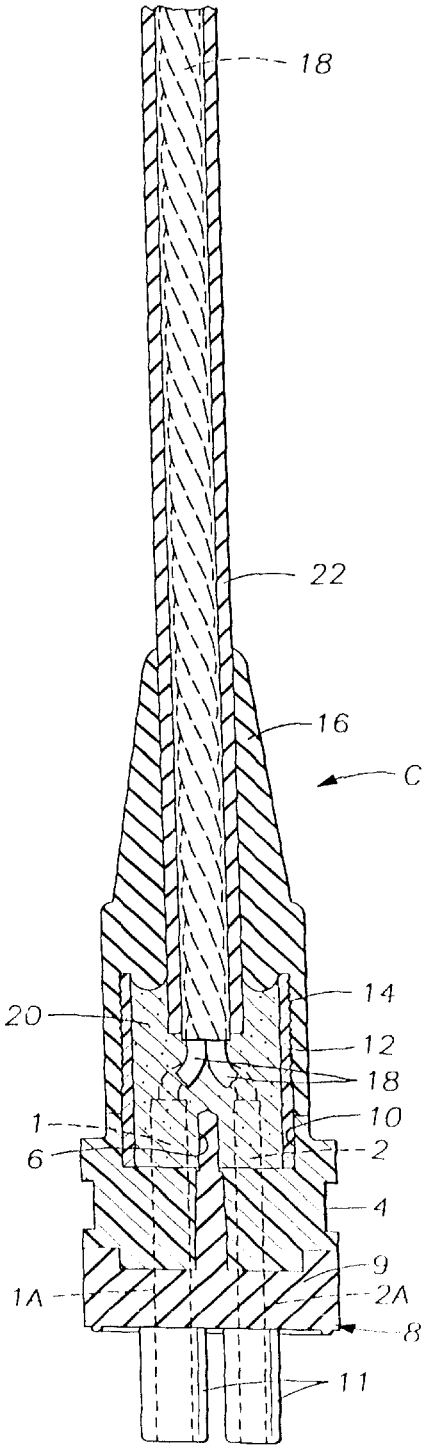
FIG. 1 is a cross-sectional view of an electrical connector in accordance with the principals of this invention.
Figure 3:
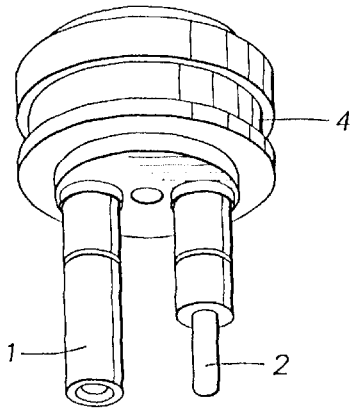
FIG. 3 is an isometric view of the connection inserts utilized with the present invention.
Figure 1A:
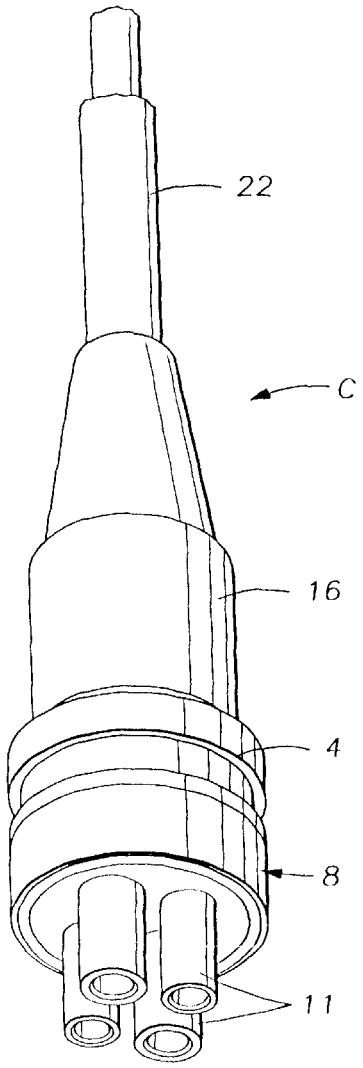
FIG. 1A is a perspective view of an electrical connector in accordance with the principals of this invention as disclosed in cross-section in FIG. 1.

Referring to FIG. 1 which discloses a preferred embodiment of the present invention the electrical conductor pins 1 and 2 are encased in a hard plastic short cylindrical insert base 4. This makeup is shown better in FIG. 3. The insert base 4, also contains a cylindrical channel 6, which extends along the longitudinal axis and substantially in the center of insert 4. An internal annular lip 10 also extends around the inside of insert 4. The insert base 4 is manufactured by molding the plastic around connector pins 1 and 2. A soft polyurethane material 8, such as BF Goodrich Estane® 58863 or 58881 is molded around the outwardly extending electrical connector pins 1A and 2A. The molding process is accomplished such that a foundation portion 9 follows the basic outline of base insert 4 while outwardly extending fingers 11 cover any connector pins such as 1A and 2A.

A back shell piece 12 is then friction fitted along the internal annular lip 10. Back shell 12 can also contain, as shown, external grooves or threads 14, which enhance and increase the coefficient of friction along that outer surface to allow for better holding of the soft polyurethane outer coating 16. However, prior to molding the outer coating 16 and at any time prior thereto, the termination of the electrical conductor wires 18 must be made at pins 1 and 2. Further, prior to the molding of outer covering 16, a potting compound 20 must be poured into and allowed to dry within the back shell 12 and internal annular lip 10 of insert 4. Potting compound 20 provides further water proof protection of the electrical connectors, further strengthens the connection itself between the electrical conductors 18 and electrical pins 1 and 2, and still further provides additional shock absorbing capabilities to the entire connector piece denoted as C. The tail over mold 16 is essentially the last step said over-mold encompassing the electrical conductor insulation 22. Insert base 4 is also made of a plastic, and therefore, allows for a fusion of the soft external covering with the insert upon the application of heat, each to the other and therefore, the integral body of the two pieces is highly suited for its use in underwater seismic exploration.

Figure 2:
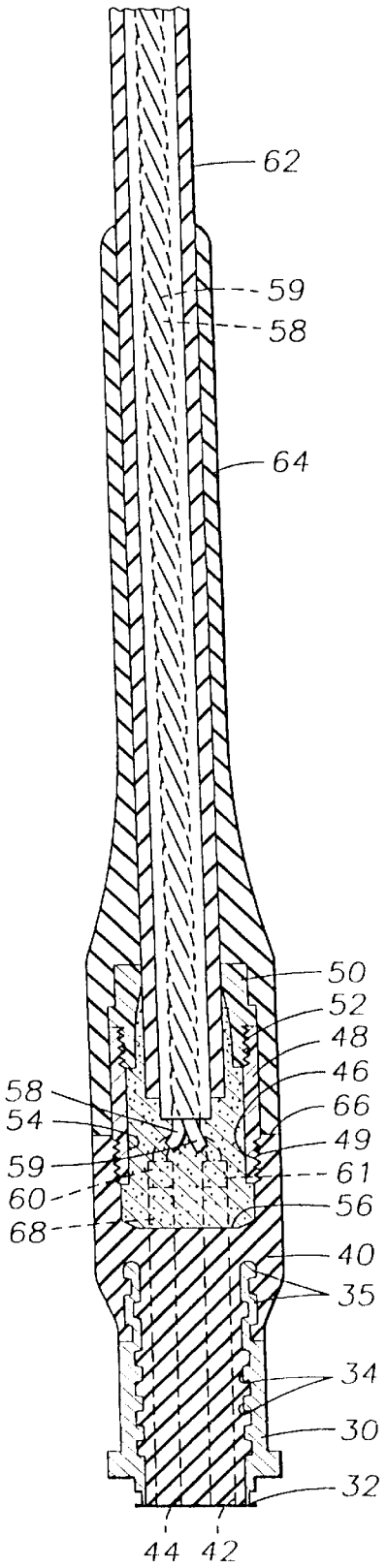
FIG. 2 is a cross-sectional view an alternative embodiment of an electrical connector in accordance with the principals of this invention.
Figure 2A:
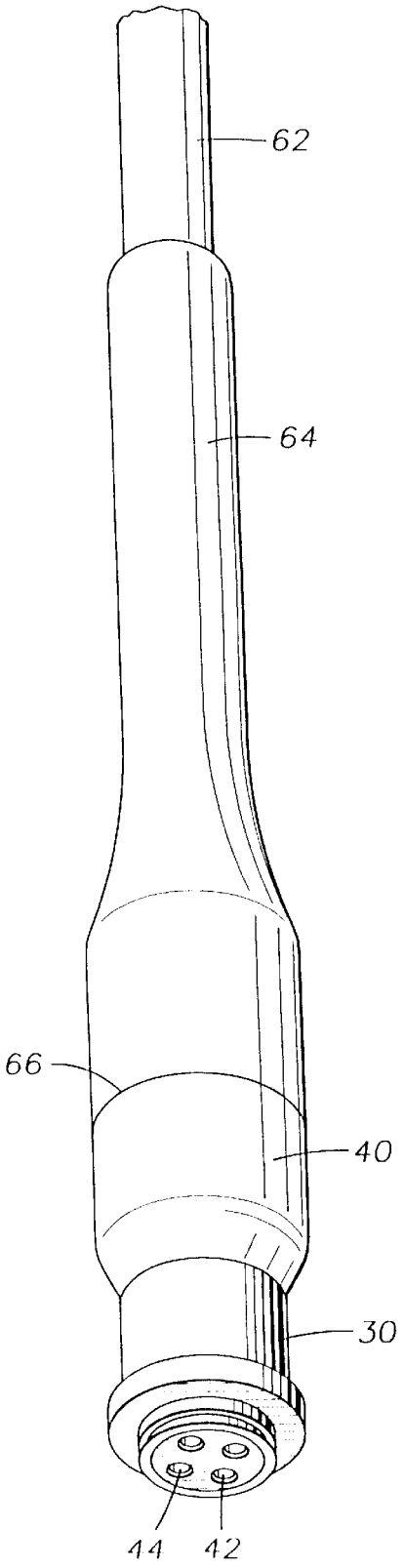
FIG. 2A is an isometric view of an electric connector in accordance with the alternative embodiment of the principals of this invention as disclosed in cross-section in FIG. 2.

Another embodiment of the present invention is disclosed in FIG. 2. In this embodiment, a soft over mold of the pins such as that identified as 8 in FIG. 1 is not required since a steel connector piece (housing) 30 is utilized. Disclosed is the male portion which fits within an external female clamp for the corresponding connector not shown.

In the embodiment of FIG. 2, the steel connector piece 30 is hollow and cylindrical with an outwardly protruding annular lip 32 at its most distal end and which includes a number of internal extending annular protrusions 34, as well as, outwardly extending angular protrusions 35 to provide for a better grip to the molded plastic 40 in which connector piece 30 is set. The molded plastic 40 is of a glass impregnated polyurethane variety best exemplified by Dow Chemical ISOPLAST® 201, a polyurethane, which is filled from 40 to 60% by weight, with fiberglass.

As disclosed in Applicant's previous patent, when this glass impregnated polyurethane is molded it sets up as a rather hard, if not semi-rigid body. The glass imports strength, as well as, rigidity to the body. In the event it is designed to increase the hardness of the plastic to better withstand abrasion and/or harsh treatment and usage, the fiberglass content may be increased or conversely lowered. It is believed that a fiberglass content in the range of 15% to 65% by weight would generally accomplish the objects of the invention as described herein. The hard plastic housing material 40 is also molded about longitudinally extending electrical connector pins 42 and 44. While only two connector pins are shown in this embodiment, connector pins can number from 1 to several depending on the desired connection to be made up.

Housing portion 40 also contains internal threads 46 which correspond to and allow for the threaded engagement of back shell 48. The internal threads are located on the inside of annular surface 66. Back shell 48 contains external threads 49 corresponding to internal threads 46 of housing 40. A pressure nut 50 threadedly engages back shell 48 at 52. Potting compound is then injected into the internal area 54 defined by the inner wall 56 of hard plastic housing portion 40, back shell 48 and pressure nut 50. The potting compound accomplishes the same functions and purposes as that described with respect to the embodiment described above. The potting compound and pressure nut are only applied after the electrical connectors 42 and 44 have already been terminated with electrical conductors 58 and 59 at points 60 and 61. Since the electrical conductors insulation material 62 remains unprotected, a soft plastic tail over-mold 64 is applied and irrevocably bonds with the electric conductor insulation 62, pressure nut 50, back shell 48 and annular lip 66 of housing portion 40 at the terminus of surfaces 64 and 40.

METHOD OF MANUFACTURING

Though the method of manufacturing is somewhat described above it will be discussed in a more step-by-step fashion herein. For the embodiment of FIG. 1, the hard plastic insert base 4 is molded about conductor pins 1 and 2. A soft plastic over-mold is then made over the outwardly extending pins 1A and 2A. A back shell piece is then snapped into and held into place by internal annular lip 10. By this point, and at any time prior hereto, electrical conductors 18 must have been terminated into electrical pins 1 and 2. A potting compound 20 is then poured into the cavity defined by insert 4 and back shell 12. The external portion 14 of back shell 12 can also include threads or knurls as shown in FIG. 1 to aid in gripping the soft tail over mold 16 which is now accomplished by injection molding.

The embodiment of FIG. 2 is best manufactured by first molding a glass impregnated polyurethane about a portion of an external clamping mandril 30 and electrical connector pins 42 and 44 within clamping mandril 30. The inwardly extending portion of this outer housing 40 is comprised of an annular bore which extends into and forms an internal chamber 54. The annular lip 66 of housing portion 40 will generally contain internal threads 46 to which a back shell 48 is threaded. At this point, or prior hereto, electrical conductors 58 and 59 must be terminated at connector pins 42 and 44 at 60 and 61. A pressure nut 50 is then threaded into back shell 48 and potting material 54 is then injected or poured into the chamber defined by internal bore 68 of housing portion 40. This arrangement also provides resilience against the environmental stress incurred by sub-sea connectors. A soft polyurethane tail over mold 64 is then injection molded thereabout to create the remaining portion of the housing and terminates at the innermost lip 66 of hard plastic housing portion 40 and irrevocably bonds to said lip as well as the external faces of back shell 48, pressure nut 50 and electrical conductor insulation 62.

It is to be understood that the form of the invention herein shown and described is to be taken as a preferred example, and that numerous variations will be obvious to those skilled in the art and in light of the teachings of this specification, without departing from the scope of the hereinafter claimed subject matter.

I claim:

1. An electrical connector comprising:

a substantially hard plastic housing having a first end and a second end having an annular lip defining a chamber, said housing encapsulating at least one electrical connector therein, a section of said electrical connector extending into said chamber;

an open ended shell connected to said annular lip;

an insulated, electrical conductor connected to said electrical connector and extending outwardly therefrom;

a potting material disposed within said chamber and about the connection between said electrical connector and said electrical conductor; and a tail member extending from said annular lip over said shell and a section of said insulated electrical conductor and bonded to said annular lip, said shell and said conductor thereto.

2. The electrical connector of claim 1, wherein:

said tail member is made of a material substantially the same as said housing and irrevocably fused at said annular lip but which is softer than said housing.

3. The electrical connector of claim 1, wherein:

said tail member is polyurethane.

4. The electrical connector of claim 1, wherein:

said housing is a fiberglass impregnated polyurethane.

5. The electrical connector of claim 4, wherein:

said fiberglass impregnated in said housing constitutes between 15 and 65 percent of the weight thereof.

6. The electrical connector of claim 4, wherein:

said tail member is polyurethane.

7. The electrical connector of claim 5, wherein:

said tail member is polyurethane.

8. The electrical connector of claim 1, further including:

a connector piece connected to and encompassing a section of said housing.

9. The electrical connector of claim 1, further including:

a nut connected to said open ended shell opposite said annular lip connection.

10. The electrical connector of claim 8, wherein:

said tail member is made of a material substantially the same as said housing and irrevocably fused at said annular lip but which is softer than said housing.

11. The electrical connector of claim 9, wherein:

said tail member is made of a material substantially the same as said housing and irrevocably fused at said annular lip but which is softer than said housing.

12. The electrical connector of claim 10, wherein:

said housing is a fiberglass impregnated polyurethane.

13. The electrical connector of claim 11, wherein:

said housing is a fiberglass impregnated polyurethane.

14. An electrical connector comprising:

a substantially hard plastic housing having a first end and a second end having an annular lip defining a chamber, said housing encapsulating at least one electrical connector therein, a section of said electrical connector extending into said chamber;

a connector piece having a section thereof connected to said housing and a section surrounding a longitudinal section of said housing;

an open ended shell connected to said annular lip;

an insulated, electrical conductor connected to said electrical connector and extending outwardly therefrom;

a potting material disposed within said chamber and about the connection between said electrical connector and said electrical conductor; and a tail member extending from said annular lip over said shell and a section of said insulated electrical conductor and bonded to said annular lip, said shell and said conductor, said tail member being made of a material substantially the same as said housing and irrevocably fused at said annular lip but which is softer than said housing.

15. The electrical connector of claim 14, wherein:

said tail member is polyurethane; and said housing is a fiberglass impregnated polyurethane.

16. The electrical connector of claim 15, wherein:

said fiberglass impregnated in said housing constitutes between 15 and 65 percent of the weight thereof.

17. A method of manufacturing an electrical connector comprising the steps of:

providing a hollow connector piece;

forming a hard plastic housing about at least one electrical connector pin, a section of said housing containing a section of said pin and extending into said connector piece, said housing having an annular lip defining a chamber into which said electrical connector pin extends;

connecting an open ended shell to said annular lip of said housing;

connecting an electrical conductor to said electrical connector pin;

disposing a potting compound within said back shell surrounding the connection of said electrical conductor and said electrical connector pin; and forming a soft plastic tail member extending from said annular lip over said shell and a section of said electrical conductor and bonded to said annular lip, said shell and said conductor, said plastic tail being made of a material substantially the same as said housing and irrevocably fused at said annular lip but which is softer than said housing.

18. The method of claim 17, further including the step of:

connecting a nut to a end of said shell opposite said annular lip, said electrical conductor passing through said nut.

19. The method of claim 17, wherein:

said tail member is polyurethane; and said housing is a fiberglass impregnated polyurethane.

20. The method of claim 19, wherein:

said fiberglass impregnated in said housing constitutes between 15 and 65 percent of the weight thereof.

* * * * *